US005518324A

United States Patent [19]

Campbell et al.

[11] Patent Number: 5,518,324

[45] Date of Patent: May 21, 1996

[54] PLATEN TO PRINT HEAD GAP ADJUSTMENT ARRANGEMENT

[75] Inventors: Michael C. Campbell; Mohsen Marefat, both of Lexington; Randall D. Mayo, Georgetown, all of Ky.; Jeffrey H. Paterra, Vestal, N.Y.; Tuyen V. Pham, Massillon, Ohio; Donald K. Rex, Highland Beach, Fla.; Kevin D. Schoedinger, Lexington, Ky.

[73] Assignee: International Business Machines Corporation, Armonk, N.Y.

[21] Appl. No.: 11,460

[22] Filed: Jan. 29, 1993

[51] Int. Cl.[6] ..... B41J 11/20

[52] U.S. Cl. ..... 400/56; 400/59

[58] Field of Search ..... 400/55, 56, 57, 400/58, 59; 347/8

[56] References Cited

U.S. PATENT DOCUMENTS

| | | | |
|---|---|---|---|
| 4,652,153 | 3/1987 | Kotsuzumi et al. | 400/56 |
| 4,676,675 | 6/1987 | Suzuki et al. | 400/56 |
| 4,737,645 | 4/1988 | Lahr | 250/458.1 |
| 4,812,059 | 3/1989 | Masaki | 400/56 |
| 4,847,638 | 7/1989 | Moriyama | 346/140 R |
| 4,881,835 | 11/1989 | Niikawaa | 400/56 |
| 4,897,670 | 1/1990 | Hasegawa et al. | 346/76 PH |
| 4,917,512 | 4/1990 | Mimura et al. | 400/56 |
| 4,927,277 | 5/1990 | Niikawa | 400/56 |
| 4,974,974 | 12/1990 | Yoshida et al. | 400/56 |
| 4,990,004 | 2/1991 | Kawahara et al. | 400/56 |
| 5,009,526 | 4/1991 | Kirchhof | 400/56 |
| 5,037,217 | 8/1991 | Suzuki et al. | 400/124 |
| 5,156,464 | 10/1992 | Sakai | 400/56 |
| 5,156,466 | 10/1992 | Inagaki et al. | 400/56 |
| 5,257,867 | 11/1993 | Ito et al. | 400/56 |

FOREIGN PATENT DOCUMENTS

| | | | |
|---|---|---|---|
| 0326344A2 | 1/1989 | European Pat. Off. | B41J 25/30 |
| 0364262A2 | 10/1989 | European Pat. Off. | B41J 25/308 |

*Primary Examiner*—John S. Hilten

*Attorney, Agent, or Firm*—Whitham, Curtis, Whitham & McGinn; Michael E. Belk

[57] ABSTRACT

A system for automatically adjusting the print head gap of an impact printer, particularly for paper stocks of differing thicknesses and multi-layer forms, provides for measurement of an absolute distance between an undeflected platen position and a home position of the print head. Paper stock thickness is measured by measuring the distance to the home position from a position of the print head when a predetermined force is exerted by the print head against the platen. Since a similar measurement is made when paper stock is not present in the printer and using the same force against the platen, platen flexure is removed as a source of error and a standardized force is available for compression of the paper stock during measurement. Improved accuracy is achieved at high speed while avoiding the use of position encoder/decoder arrangements. A wider range of manufacturing variations in printer geometry and rigidity can be accommodated with uniformly improved print quality.

11 Claims, 6 Drawing Sheets

PLATEN TO PRINT HEAD GAP ADJUSTMENT ARRANGEMENT

BACKGROUND OF THE INVENTION

Field of the Invention

The present invention generally relates to printers suitable for use with data processing systems and, more particularly, to impact type printers, such as pin printers, capable of printing on stock of varying thickness, including multiple copies on layered stock.

Description of the Prior Art

The increase of use of data processing systems and personal computers, particularly by businesses, has been accompanied by increased demand for printers capable of providing a high quality type font at high speed. Numerous technologies have been investigated for simultaneously answering these two requirements. However, current business practices often involve the need to print multiple copies at the same time on layered stock and not all printer technologies are suited to such requirements.

Such multiple copies, which are often color-coded for regulating distribution and communication of respective ones of the copies, are often preferred because of the assurance they provide of exact duplication of the information printed and for the convenience of uniformity of the number of copies and the ability to establish procedures for handling of each copy. These attributes are relatively difficult to duplicate with printers using, for instance, laser and ink-jet technologies since these technologies do not provide a mechanism for producing an image on other than the surface layer of multi-layer stock. Data processing techniques for generating multiple, serial copies has generally been limited to automatic generation of labels, often printed in the margins of documents. Even then, the very flexibility of data processing systems does not assure that the same number of copies with the same use, distribution or disposition designations will be uniformly produced. The production of color-coded copies, which may be easily accomplished with layered stock, requires the maintenance of inventories of multiple paper stocks and, often, the manual feeding of these different stocks to the printer unless complex and costly sheet feeders are employed.

Printer technologies which are capable of forming images on each layer of multi-layer stock generally rely on impact forces which may be transmitted through all sheets of the stock. Some such printers use technologies which are outgrowths from the typewriter arts such as so-called type ball and daisy wheel printers. Such technologies develop full "letter quality" but are limited in the number of characters and fonts which can be produced without manually changing the type ball or daisy wheel. So-called band printers are similarly limited. To produce a greater number of characters, symbols and fonts in a variety of symbol point sizes and pitches, so-called pin printers have gained widespread popularity and have developed resolution capabilities (e.g. dots per inch) which allow print quality to approach that of laser and ink-jet printers at the level of human visual perception. For purposes of this disclosure, both of these technologies (e.g. type ball, daisy wheel, band and pin printers) will be generically referred to hereinafter as "impact" printers.

Impact printers are well-known and are in widespread use at the present time. Being principally reliant on mechanical action of a relatively limited number of parts in the print head and transport therefor, they are generally less expensive than printers using other technologies. Further, while the actual printing action is far slower than in comparable laser or ink-jet printers, the mechanical constraint to lower image dot pitches reduces the amount of time required for "spooling" or the mapping of symbol codes to a dot image or character map from which the printer is driven. Therefore, overall printing time is comparable and may be less than that of laser and ink-jet printers, particularly on printed forms where relatively few characters or symbols are to be formed. (In contrast, ink-jet and laser printers typically form a dot image of the entire page or form prior to printing.) Accordingly, impact printers remain preferred for many applications, even where printing on multi-layer stock is not required.

Due to the mechanical action of impact printers, the print head to platen spacing is relatively critical to the print quality produced, especially in regard to the stock on which printing is done. The spacing between the print head and the platen or the surface of the paper stock relative to the distance over which the pins or type are accelerated greatly affects the impact forces which are applied to the stock. The optimum velocity is also subject to numerous other printing variables and parameters. For example, most impact printers include a ribbon for applying ink to the stock or the uppermost layer thereof and the forces applied thereto affects the efficiency with which ink transfer to the stock takes place. The mechanical motion of the ribbon, the amount of ink carried thereby and the texture of the paper are only a few of many other conditions which affect print quality and require relatively close regulation of pin or type velocity to obtain results which are considered satisfactory at the present state of the art. Therefore, it is common practice at the present time to at least provide manual adjustment of the print head to platen distance in order to allow for near-optimization of the print quality for different stocks.

It can be understood, however, that manual adjustment of print head to platen distance is not fully satisfactory to achieve optimum results. Consider, for example, that a routine printer application might involve use of the same printer to produce a letter and to address the envelope in which it is to be mailed. The letter might be produced on bond paper and a copy made on a lower quality or lighter weight paper. The envelope will be of varying thickness including areas in which two, three and four layers of paper are present, respectively. While a lower print quality might be acceptable on a file copy of the letter, the difference in print quality between the letter and the envelope will be evident unless adjustment is made. Therefore, two or more printer adjustments are potentially required for each piece of correspondence unless a compromise head to platen spacing is used.

Multi-layer stock forms may also vary in thickness between areas thereof and may require adjustment for each area. An acceptable compromise spacing may not be possible if the variation in thickness is sufficiently great. Further, for purposes of comparison, it has been found that, at the present state of the art in impact printers, a change of print head to platen or stock spacing (hereinafter simply "print head spacing") as small as 0.001 inches has a visible effect on print quality. Manual adjustment to this accuracy is not readily accommodated by mechanisms which also allow for repeatability and convenience of adjustment. Therefore, various arrangements have been attempted to provide for automatic print head spacing adjustment to accommodate different stock thicknesses.

One arrangement for automatic adjustment of print head spacing (which is specifically not admitted to be prior art as to the present invention but is summarized here in order to convey an understanding of the distinctive features of the present invention) involves use of the print head itself to measure the thickness of paper stock. In this arrangement, a motor is used to drive an adjustment mechanism which controls head spacing but is capable of bringing the print head into contact with a first designated area of the platen where paper stock will not be present and to repeat the process at another location where the paper stock is located. A position encoder such as a disk with coded apertures is used to determine the head location when contact is made in these respective areas. Contact is detected by sensing the rate at which sequential positions are reported by the encoder, assuming that a decrease in rate or cessation of position change (e.g. by stalling of the motor) indicates contact between the head and the platen or paper stock. The difference in head positions is then taken as the stock thickness.

However, this arrangement has several drawbacks. For example, the reliance on a position encoding member also requires use of a decoder; both of which increase expense of the printer. The position encoding member also must be of relatively high precision or of substantial size. The encoding member may also be less than fully reliable in use since the sensing of head position may be defeated by collection of dust or misalignment of the sensors with the encoding member. Perhaps more importantly, however, the sensing of contact by slowing of position information is not a sharply defined condition since it assumes a substantially rigid platen and head transport mechanism as well as a substantially incompressible paper stock. If the head transport rate (e.g. the position data rate) were to be plotted over time, a more or less soft "knee" would appear as the head comes in contact with the platen and flexure in the platen and head transport occurs. When measuring paper stock thickness, an increased compressibility of the paper stock or sheet material covering the platen (as would be expected as the number of layers in a multi-layer stock is increased) will increase the softness of the knee. Thus the curves obtained would not be the same and would vary between paper stocks as well, requiring a subjective determination as to the point at which contact is considered to have occurred. This determination will also have varying accuracy between paper stock and will vary between printers due to slight manufacturing differences in platen and head transport structures.

Further, in regard to manufacturing differences between printers, the above-described technique does not have an absolute reference position since some flexure of the platen and head transport mechanism will always be present. Conversely, the above-described technique encourages use of more expensive platen and head transport structures in order to increase rigidity thereof beyond the degree of rigidity which has a beneficial effect on print quality. Manufacturing differences in the structure of the platen and head transport mechanism thus require careful calibration and adjustment of the print head gap adjustment system during manufacture; increasing the cost of the completed printer while yielding less than fully satisfactory results.

SUMMARY OF THE INVENTION

It is therefore an object of the present invention to provide a print head positioning system which is capable of repeatably and accurately measuring paper stock thickness and automatically positioning the print head of a printer to provide a print head gap appropriate to paper stock thickness.

It is another object of the invention to provide a print head positioning system in which flexure of the platen and print head transport structures are fully compensated.

It is a further object of the invention to provide a print head positioning system which avoids the use of a position encoding/decoding arrangement and is inexpensive to fabricate and calibrate.

In order to accomplish these and other objects of the invention, a method of automatically setting a gap between a print head and a platen of an impact printer is provided, including the steps of establishing a distance between a home position of the print head and the platen, moving the print head against the platen, moving the print head from the platen to the home position while accumulating a first distance measurement, placing sheet material between the print head and the platen, moving the print head against the sheet material, moving the print head from the sheet material to the home position while accumulating a second distance measurement, subtracting the second distance measurement from the first distance measurement to obtain a thickness measurement, and selecting one of a head gap dimension and a head motion distance which corresponds to the thickness measurement.

In accordance with another aspect of the invention, a printer and system for setting a head gap in a printer are provided including a print head drive arrangement for driving a print head toward and away from a home position and driving the print head against at least one of the platen and sheet material covering said platen, an arrangement for accumulating distances when the print head is driven from the platen or sheet material covering the platen, an arrangement for subtracting one the distance accumulated when the print head is driven from the sheet material covering the platen to the home position from a distance accumulated when the print head is driven from the platen to the home position to derive a thickness of the sheet material, and an arrangement for selecting one of a print head gap and a print head travel distance in response to the thickness of said sheet material covering said platen.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
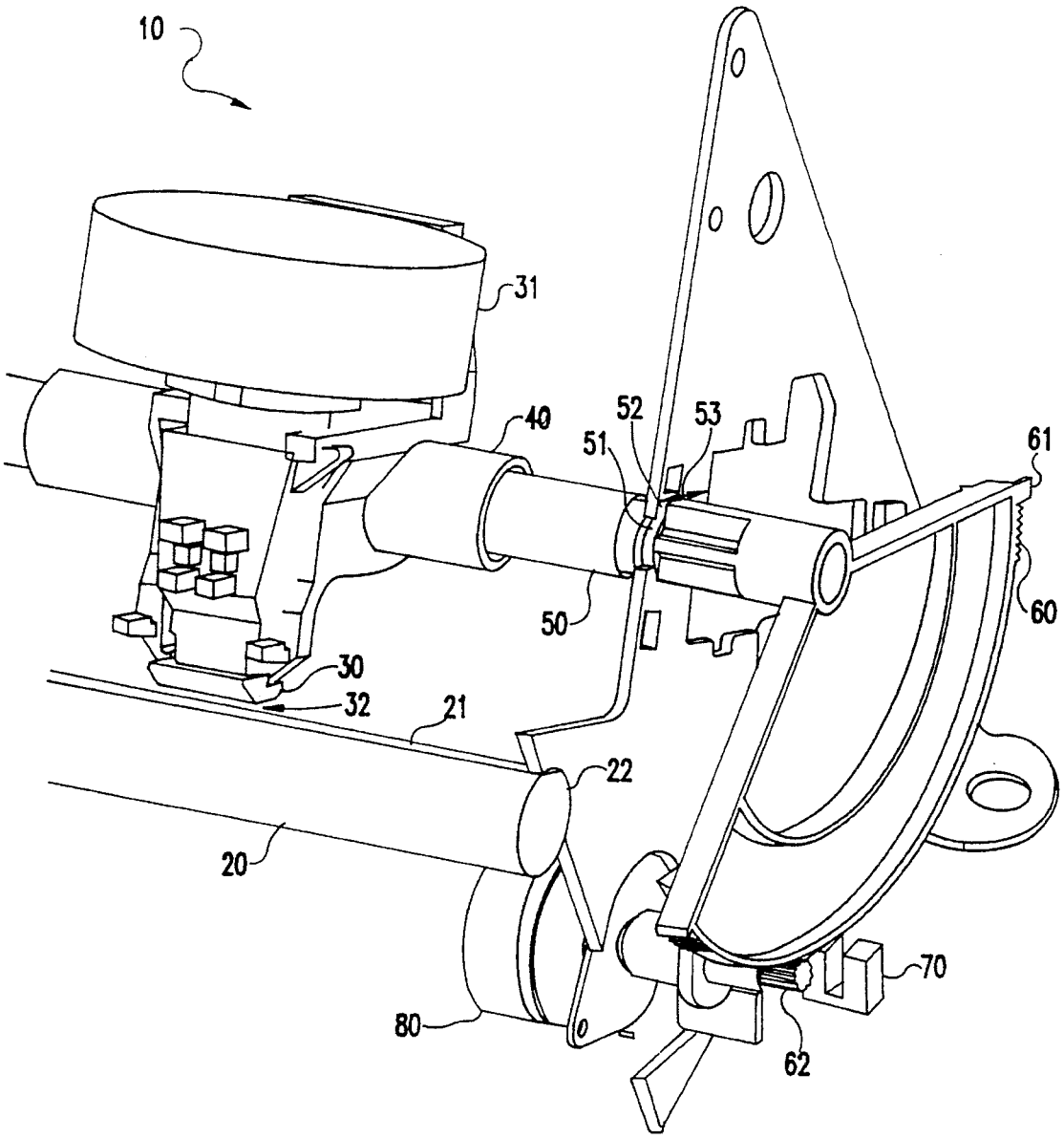
FIG. 1 is an exemplary mechanism providing for adjustment of head gap.

Referring now to the drawings, and more particularly to FIG. 1, there is shown an exemplary structure 10 for providing adjustment of head gap adjustment, in accordance with the invention. While this exemplary structure is considered to be generally preferred, the details thereof are not critical to the practice of the invention. However, application of the invention to other structures will be made evident to those skilled in the art through comparison of other structures with the structure of FIG. 1. Specifically, mechanism 10 includes a platen which is preferably formed as a flat surface 21 on a cylindrical rod which is supported against circular or semi-circular recesses 22. The platen may actually be supported by other means (not shown) but the recesses 22 provide accurate alignment of the print head path along the platen regardless of the position of the flat surface 21. The mechanism for causing movement of the print head across the platen is not important to the practice of the invention but is preferably achieved by a belt drive (not shown) which causes the print head body 31 to slide along shaft 50. A further support shaft (not shown) slidably engages print head body 31 to prevent rotation of the print head body. This further support shaft also provides for arcuate motion of the print head body 31 having a radius which is large in comparison to the maximum head gap when the head gap 32 is adjusted so that adjustment of the print head gap 32 does not significantly alter the alignment of the motion of the type or pins of the print head in a direction substantially orthogonal to the flat platen surface 21.

For adjustment of the head gap 32, the shaft 50 is provided with bearings 51 at each end which are non-concentric with shaft 50. The bearings 51 are, of course, coaxial. The bearings 51 are supported by support surfaces 52, preferably in the form of grooves, at both ends and the shaft 50 is rotatable about the axis of bearings 51 by means of sector gear 60. For that reason, it is convenient to refer to shaft 50 as an eccentric shaft. Grooves 52, in combination with the further shaft referred to above, allow the head gap to be adjusted by the eccentric shaft 50 without shift of the print head body 31 in a direction orthogonal to the length of platen 21. In other words, when the further shaft restrains the motion of the print head 31 to arcuate motion about the further shaft, bearings 51 can ride in and out in the direction indicated by arrows 53 to avoid binding of the mechansm.

Sector gear 60 is driven by a stepping motor 80 through pinion gear 62. Sector gear 60 is also preferably provided with a projection 61 which may be sensed either optically, electrically (e.g. capacitively) or magnetically when sector gear is driven to a position which locates the projection 61 or an edge thereof at the location of sensor 70. This location preferably approximates a position of eccentric shaft 50 which causes head gap 32 to be approximately maximum and will be referred to hereinafter as a "home" position. It is important to a full understanding and appreciation of the invention to recognize that this home position is an absolute position which is independent of platen position and the absolute dimension of the head gap.

Figure 2:
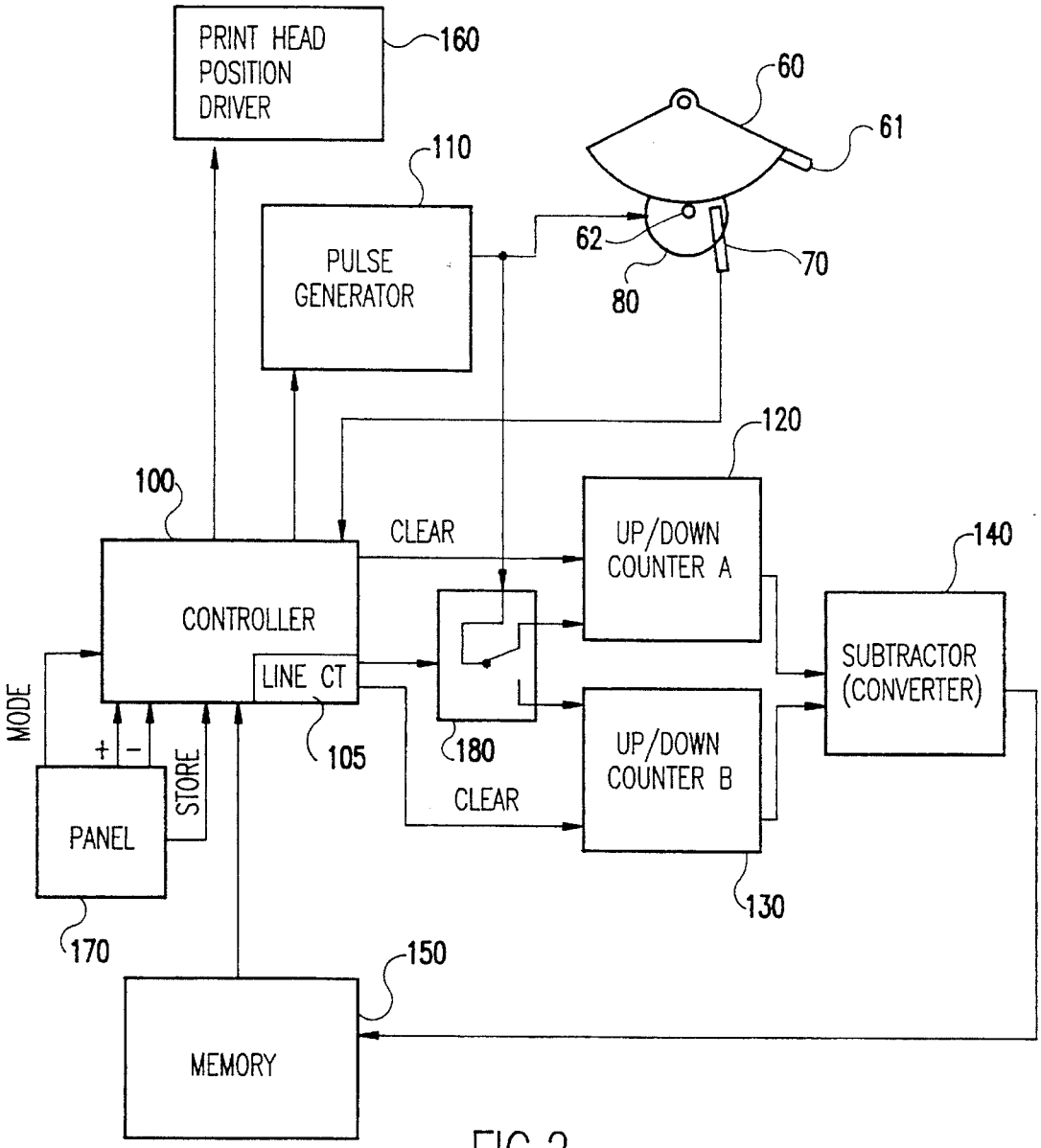
FIG. 2 is a schematic diagram of the system in accordance with the invention.

Referring now to FIG. 2, the system in accordance with the invention is schematically shown. The pertinent portions of the head gap adjustment mechanism 10 of FIG. 1, including sector gear 60, projection 61, pinion gear 62, sensor 70 and stepper motor 80, are similarly referenced in FIG. 2. A controller 100, preferably in the form of a programmed microprocessor which can also provide many of the other functional elements of FIG. 2 as well as controlling other printer functions, directly controls pulse generator 110 and print head position driver 160. The print head position driver 160 provides for movement of the print head across the platen 21 (e.g. along a printing line). Pulse generator 110 provides drive pulses to a reversible stepping motor 80 for causing adjustment of the head gap as described above. It is also preferred that pulse generator 110 be capable of limiting the current (such as by insertion of a series resistance) supplied to the stepping motor 80, as will be discussed below. These pulses are also counted by up/down counters 120 and 130, respectively, in dependence on the particular step of the head gap adjustment process is presently being executed by controller 100, as depicted schematically by switch 180. Controller 100 is also made responsive to a control panel 170, which need be no more than a plurality of switches for controlling operational mode of the printer. Feedback is also provided for establishing predetermined head gap dimensions for differing thicknesses of paper stock through subtractor 140 which compute a difference in the values accumulated in up/down counters 120 and 130. This computed difference value is then preferably used as an address to access numbers in memory 150 which govern the length of a pulse train necessary to develop a predetermined head gap for each thickness of paper stock.

Figure 3:
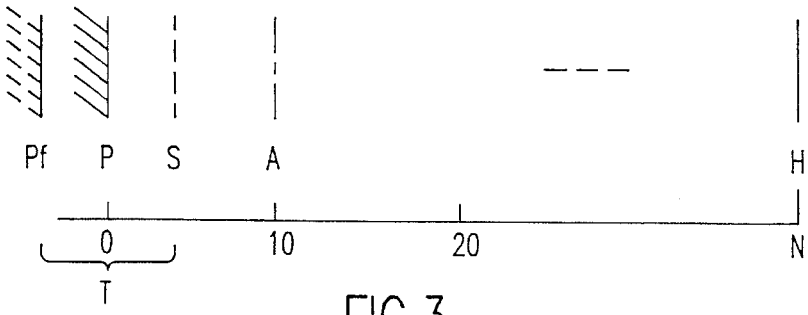
FIG. 3 is a diagram useful in understanding the print head motion in accordance with different operational modes of the invention.

The above-described arrangement supports three principal operational modes of the printer in accordance with the invention: an absolute print head to platen measurement, a paper thickness measurement and head gap setting. These operational modes will now be summarized to provide an understanding of the invention. To assist in visualization of these operational modes, reference is now made to FIG. 3 which illustrates the relative locations of the platen (location P), a displaced platen location Pf (due to platen flexure), the paper stock surface (location S, thickness T in front of Pf), an adjustment start position (location A) and the home position (location H). The scale in the lower portion of FIG. 3 provides a nominal count of pulses to stepping motor 180 which would provide corresponding print head motion arbitrarily indexed to the platen position P (although counting will often begin at the home position, as will be discussed below).

The absolute print head to platen measurement is used principally during manufacture and/or repair and maintenance of the printer. The function of this mode of operation is to obtain a count value corresponding to N of FIG. 3. For this purpose, a self-test process is initiated by the actuation of a switch on operator panel 170. Upon initiation of the self-test process, the controller 100 causes pulse generator 110 to provide pulses to the stepper motor 80 to move the print head away from the platen until a home position is reached, as detected at sensor 70 which senses the arrival of projection 61 at the sensor location. The print head position will now be at location H of FIG. 3 and the largest possible clearance above the platen will be provided. Upon detection of the projection 61, indicating that the home position has been reached and the clearance achieved, controller 100 causes the print head position driver 160 to move the print head toward the platen by a fixed distance, preferably about 0.040 inches. This amount is relatively arbitrary but preferably a substantial fraction (e.g. about 80%) of the maximum head gap which can be obtained, in order to reduce the manual stepping of the head motion or range of gap measurement by assembly personnel which is to follow. However, this dimension should be short enough to accommodate manufacturing tolerances so as not to cause contact between the print head and platen during this automatic head movement. Preferably, then, the automatic head motion toward the platen should, on average, leave a gap of about 0.010 inches.

At this point, the remaining print head gap can be measured, preferably with a feeler gauge, and the additional distance entered by manufacturing personnel by means of the control panel 170. This measured additional distance is added to the fixed distance through which the head has been moved from the home position.

Alternatively, a predetermined thickness of feeler gauge could be used in combination with further stepping of the head position toward the platen. However, since an absolute distance measurement is sought, the alternative procedure can introduce errors since it would combine head travel based on a fixed distance with travel over a plurality of steps (which may not exactly correspond to known distances.) This provides an absolute measurement of the distance from the print head to the platen without causing platen deflection and which will be referred to hereinafter by the notation "Ad". (In the alternative procedure, the head should be backed away from the platen and the gap again measured to confirm avoidance of platen flexure.) It should be noted that in the preferred embodiment of the invention, step counts are converted to distances and calculations are made on the basis of such distances, in the interest of standardization of default values. However, it is to be understood that the invention can be practiced to the same accuracy and beneficial results on the basis of step counts.

The paper thickness measurement operation is basically a three step measurement in which the platen flexure and paper stock compression are measured in turn and then paper thickness is calculated. The paper thickness measurement is carried out either manually or, preferably, automatically whenever an absence, reinsertion or change of paper stock is detected. When this operation is initiated, the system first steps the head away from the platen to the home position. When the home position is reached, The print head is stepped rapidly toward the bare platen at a position where paper stock would normally be located at a high rate of speed, preferably at about 700 steps per second until a gap of about 0.030 inches is achieved (based upon the absolute head gap measurement discussed above). Then the stepping rate is reduced to a rate of preferably about 33 steps per second and the driving current from pulse generator 110 is reduced to about one-third to ensure that the system stabilizes mechanically (e.g. vibration from stepping becomes damped) between steps until the stepping motor stalls. The total number of steps at each of the fast and slow rates is sufficiently large (due to the change in rate at a gap of 0.030 inches) to insure that the stepping motor reliably stalls while taking up all system clearances, lost motion and flexure at the reduced drive current. Once the stepping motor has become stalled in this manner, the step count is zeroed and the head is returned to the home position at high speed while steps of the stepping motor are counted and the number stored. This number of steps will be recorded and referred to hereinafter as "F".

Next, the print head is again driven against the platen in the same manner as described in the preceding paragraph except that the number of steps is preferably limited to F+4. A verification or correction of the count F is obtained when the count is zeroed and the head is again returned to the home position while counting steps of the stepping motor 80. This step count will be referred to hereinafter as "F1" and is stored in the same manner as F. The measure of mechanical flexure is obtained by comparison of F and F1. If count F is equal to count F1, the platen flex value, Pf, is set equal to F1. If the counts are not equal the platen flex value is set to "Fi" minus two steps (e.g. one half of the difference between the number of steps between this measurement and the previous measurement).

Upon insertion of paper stock, the paper compression measurement is made in the same manner and at the same location along the platen as described above, with current reduction at pulse generator 110. The number of steps to return to the home position is preferably converted to inches and stored as value "P". The paper thickness, as compressed in this step, is calculated by subtracting "P" from "Pf" and is stored as "T". T may also be verified by reiteration of this process, if desired, in the same manner as the platen flex measurement. However, it is considered unnecessary to limit and then increment the limited number of steps for the reiteration, as was done during the platen flexure measurement for Pf.

The print head to platen gap corresponding to paper thickness may now be set since all information is available to do so. As nearly as possible, all standard paper thicknesses "T" likely to be encountered (and which will also generally identify multi-layer forms) will have an optimum print head gap dimension "G" empirically derived by the printer manufacturer and specified therefor in a memory 150 (FIG. 2). Therefore the value "T" may be used directly to address memory 150 to obtain a value "G" which is subtracted from measurement (or count) Ad to obtain a movement dimension M and/or step count Ms which will establish the proper head gap according to the measured paper stock or form thickness.

Since the printer is subject to vibration as a consequence of impact printing and the head gap setting operation can be done very quickly, it is also preferred to provide for verification of paper thickness and print head gap adjustment this can be done on an operating time basis or on a count of lines printed. As a perfecting feature of the invention, one or more line and/or character count registers 105 (FIG. 2) may be provided to cause initiation of head gap settings at several line locations or even at character locations within a line to accommodate custom multi-layer forms, if desired. Similarly, control codes could be inserted in the text of a document to be printed which would initiate the head gap setting process at the will of the user, particularly in connection with word processor produced forms.

Referring now to FIGS. 4A–4D, a preferred method in accordance with the invention will be discussed in detail. In this preferred method, the operations in accordance with the invention fall into four general groups illustrated in respective ones of these Figures: The location of the home position and the measurement location on the platen, illustrated in FIG. 4A; the measurement of platen flexure, illustrated in FIG. 4B; the measurement of sheet material thickness, illustrated in FIG. 4C; and the setting of head gap, illustrated in FIG. 4D. In these Figures, the abbreviation "AFTA" will be used to refer to the Automatic Forms Thickness Adjustment system of the invention and the current state thereof.

Figure 4A:
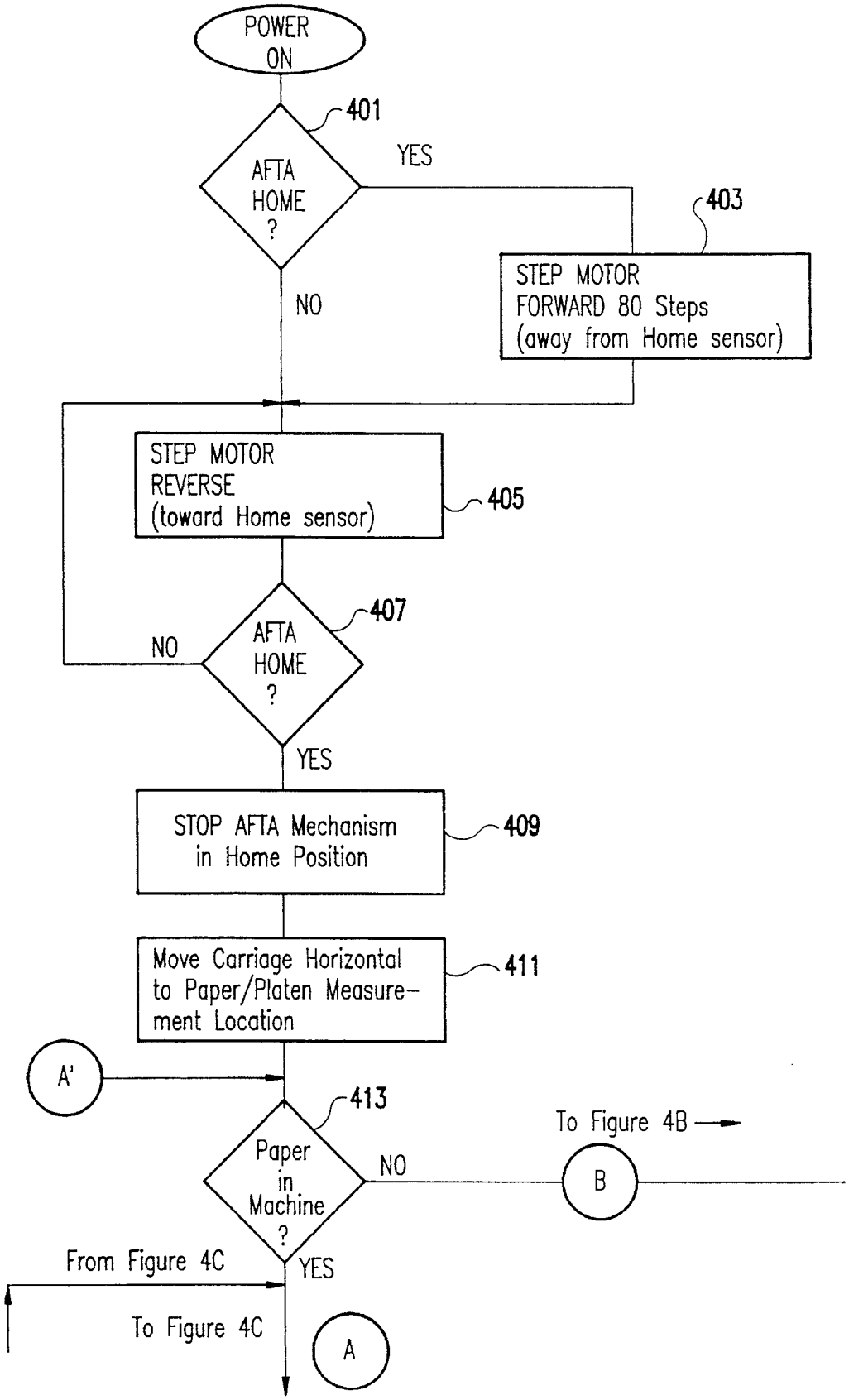
FIGS. 4A, 4B, 4C and 4D are flow diagrams illustrating operation of the invention.

Beginning with FIG. 4A, since it is necessary for the printer to be able to find the home position, the detection of the projection 61 by sensor 70 is tested at 401 whenever power is turned on. It is possible, due to the size of projection 61 that this detection may be ambiguous if the body rather than the edge of projection 61 is detected. Therefore, if the projection 61 is detected, operation 403 causes the head to be stepped a number (e.g. 80) of steps toward the platen which is greater than the width of the projection. Then, in either case, the head is stepped toward the home position by one step at 405 and the sensor 70 output tested at 407. Operations 405 and 407 are repeated until the home position is detected, at which point the head movement is halted in a direction orthogonal to the platen (409) and the carriage or print head is moved along the platen (411) to a chosen position at which measurements are to be made. Then a determination is made as to whether or not sheet material such as paper or form stock is present in the printer at operation 413, resulting in branching to either FIG. 4B or FIG. 4C.

Assuming that no paper was present in the printer, it is further assumed that calibration of the system should be done for verification of dimensions stored, since this can only be done at the same location which will be covered with sheet material when such sheet material is not present. Alternatively, a different location which will not normally be covered by sheet material can also be provided on the platen even when sheet material is present in the printer. However, this alternative is not preferred since it is likely to introduce inaccuracy into the measurement of platen flexure.

Calibration of the system begins with the setting of a number corresponding to a fixed distance from the home position as the step count at operation 421. Then the head is stepped toward the platen by one high speed step at 423 and the step count decremented at 425 and the count tested for equality to zero at 427. The process then loops to 421 and further high speed steps taken, one at a time, until operation 427 causes branching to 429 where the step count is reset to a number of steps corresponding to a distance greater than the remaining distance to the platen and large enough to ensure consistency of operation (e.g. motor stalling) and damping of vibration after each step. Then operations 431, 433 and 435 cause low speed stepping of the head toward the platen, one step at a time (and preferably with reduced motor current on the first execution of steps 423–441 after branching at 413) in the same manner as in steps 423–427. When the step count reaches zero, it is assumed that the motor has been stalled for at least one step. Then, the print head is stepped in reverse at high speed and one step at a time until the home position is detected by repeatedly looping through steps 437, 439 and 441.

If this is the first time steps 423–441 have been executed after branching at 413, that fact is detected at 443 to cause branching to 445 which stores the step count or the step count as converted to inches or a similar distance unit at 445. Then the step count is incremented at 447 by a small number (e.g. four steps) and decremented by the same number (e.g. 88) of low speed steps used in the first pass and steps 423–443 are repeated precisely as before. The reason for this is the possibility that when the head driving motor stalls with the print head against the platen, additional driving pulses could cause the head to bounce back away from the platen. On the first pass, since the step count is set to be large, this possibility should not be neglected. However, the bounce is generally limited in size and has been experimentally determined for at least one printer design, not to exceed a distance corresponding to four steps. In any event, the number of additional steps should correspond to a distance as large as whatever bounce may be encountered. By the same token, when the increment is limited to the size of the bounce, the number of stepping pulses during which the motor is stalled is markedly reduced as is the likelihood that a bounce will occur. Nevertheless, stalling of the motor is virtually assured. This, in turn, assures that the second pass will be accurate within the size of the bounce and can be reached with only two iterations in order to save time. Therefore, while high accuracy could be achieved with a plurality of loops through steps 423–441, it is preferred to branch out of the loop at 443 on the second pass, set the second pass step count to F1 at 449 and to compare F with F1 (e.g. by subtraction using subtractor 140) for equality at step 451. It should be noted in this regard that F1 is extremely unlikely to be less than F due to the reduced likelihood that a bounce will have occurred on the second pass where no bounce occurred on the first pass. Therefore, it is sufficient to the practice of the invention to set the value of Pf, preferably converted to inches, equal or equivalent to F1 at step 453 if F1 is equal to F and to set Pf equal or equivalent to F1 decreased by 2 at step 455 if F1 is not equal to F. This limits any error to one step in only two iterations of driving the print head between the home position and the platen. At this point, the distance from the home position to the flexed platen position is known. The platen flexure dimension is contained within the value Pf since the absolute platen to home position dimension is known. Also all lost motion and pertinent clearances in the printing system have been taken up during this measurement while the print head and platen are in contact.

Figure 4B:
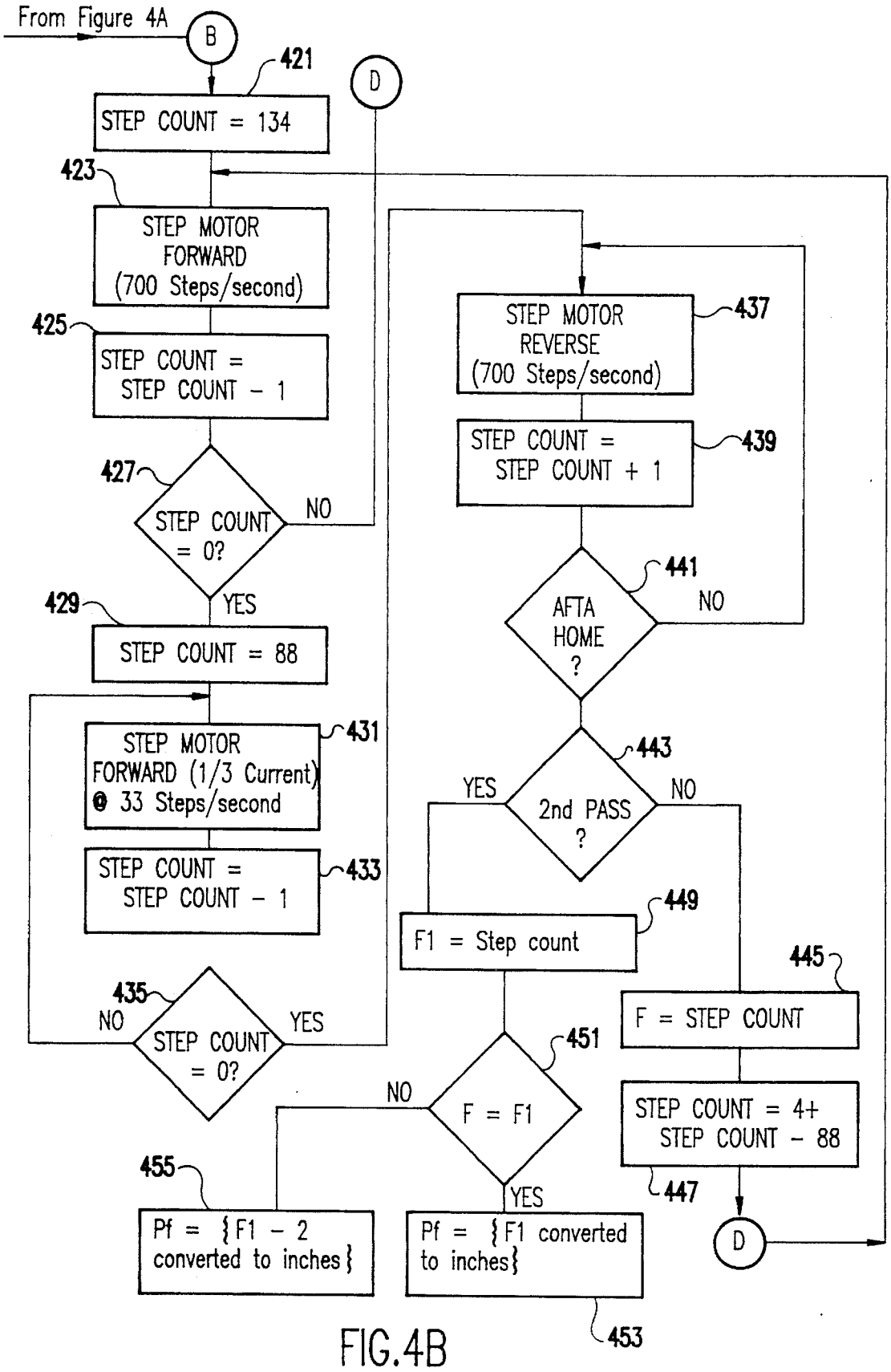

The process now continues at point F (FIG. 4D) to ascertain if any other dimensions are required or if printing may proceed. It will be assumed that a print command has not become executable (e.g. the printer is off-line) if other dimensions are required. If steps 459 detects that Pf has not been stored or is otherwise unavailable, the process branches to B and the process of FIG. 4B is repeated. Likewise, if step 461 determines that the dimension P (which assumes the presence of sheet material in the printer) is not available, the process branches to A and, if sheet material is present in the printer, the dimension P is determined, as will be discussed below. If the absolute home position to platen distance is not available (e.g. when an off-line self-test or set-up procedure has been initiated), the process branches to step 465 which sets a predetermined step count to move the head from the home position a fixed distance toward the platen and the steps executed through a loop including steps 467 which causes a high speed step, 469 which decrements the step count and 471 to a step count of zero. Then the process is halted for a measurement of the remaining distance to the platen and, when this value is entered from panel 170 an addition operation is carried out in controller 100 to calculate and store value Ad.

Once all of these values are present, all information necessary to setting of the print head gap are known and printing commands can be executed either immediately or, if the head gap has not been set, the process can branch at 476 to do so. In this regard, as will be explained in greater detail with reference to FIG. 4C, the head motion dimension M necessary to setting the head gap is computed as an incident to measurement of the dimension to the sheet material and the sheet material thickness and will be available whenever a valid value for P is available.

Figure 4C:
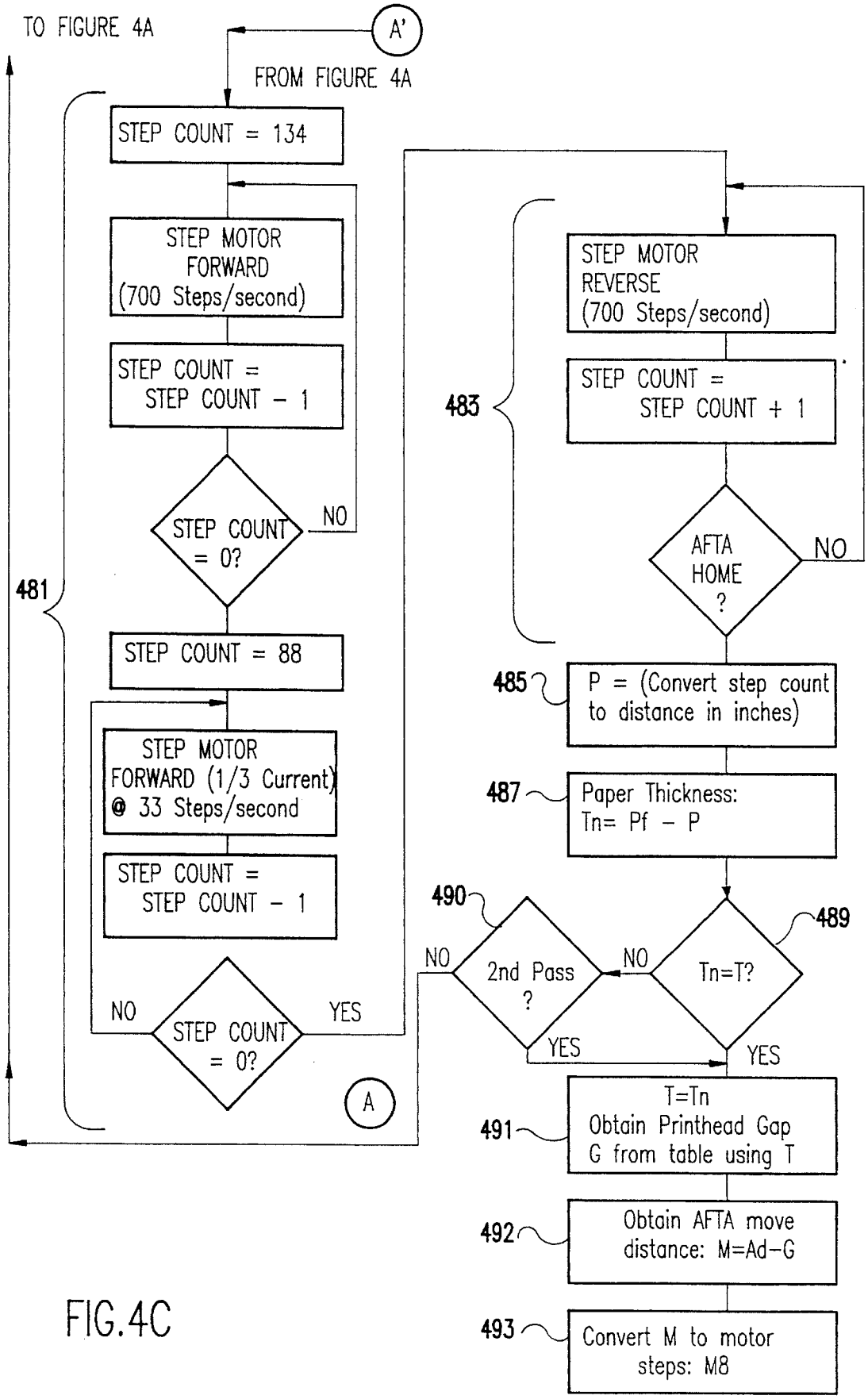
Figure 4D:
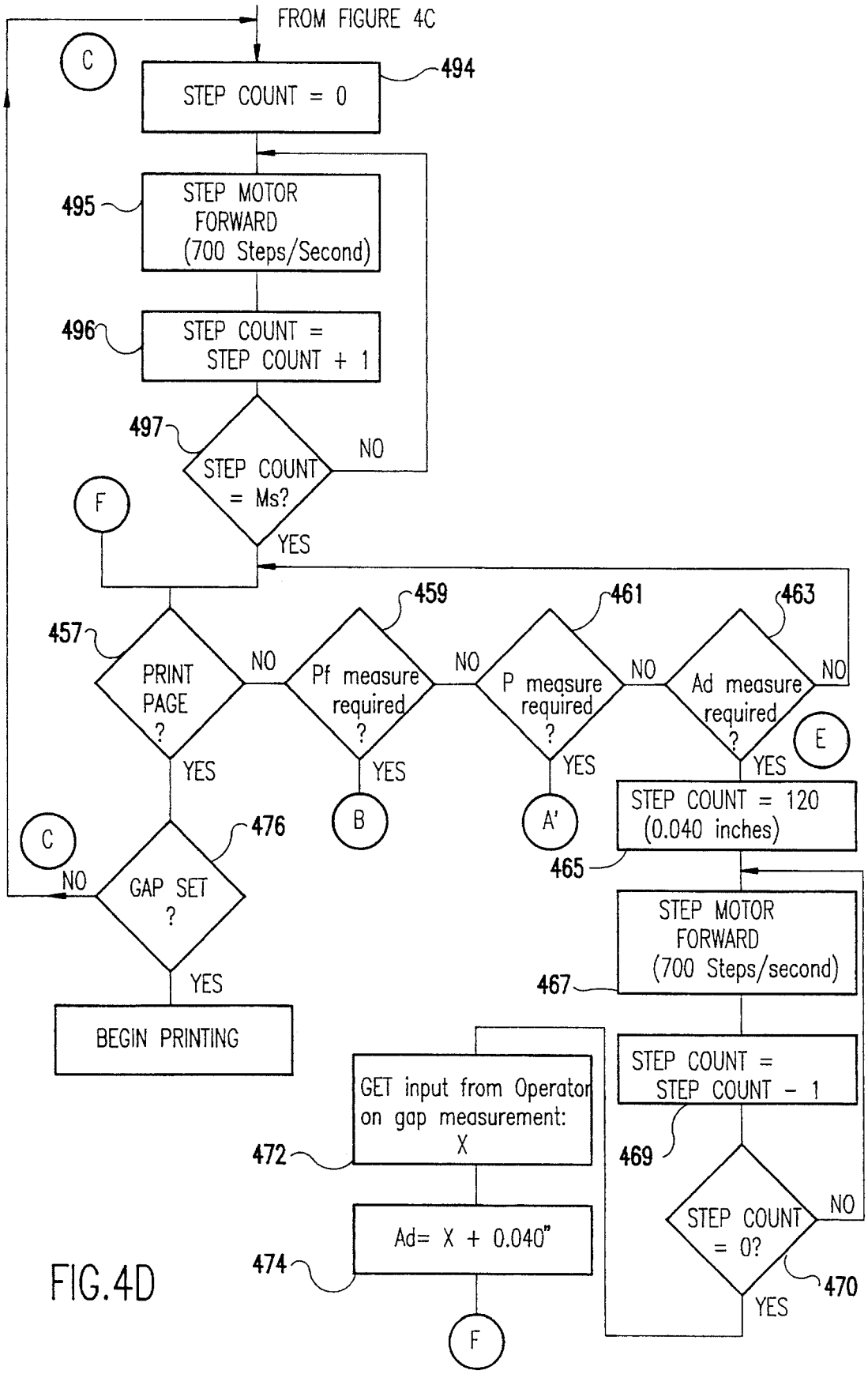

If However, P is not available when tested at 461, the process loops to A' of FIG. 4C. Steps indicated by bracket 481 correspond precisely to steps 421–435 of FIG. 4B except that sheet material is now present in the printer. Similarly, the steps indicated by bracket 483 precisely correspond to 437–441. At step 485, P is determined in precisely the same manner as Pf. The reduction in motor current and stepping speed assure equivalent stabilization between steps and equal forces on the platen when the motor becomes stalled. Hence equal platen flexure is assured during both the Pf and P measurements. New thickness Tn ("n" indicating a new value for thickness T) is computed by subtracting P from Pf at 487. If this value has changed from a previous thickness T, as determined at 489, the thickness is verified by looping once to A. It should be noted that bounce is unlikely due to the presence of sheet material and incrementing and resetting of the step count is not considered necessary but could be done in the manner of FIG. 4B, if desired.

T is then set equal to Tn at 491 and a gap value G is fetched from a table or memory (e.g. 150), preferably using T as an address. The motion from the home position M required to achieve this gap to the undeflected platen is calculated from the absolute platen distance Ad measured at steps 465–474 and G by subtraction at step 492 and this distance, if not in motor steps, is converted to a number of motor steps Ms at 493. Ms could also be directly stored and retrieved but such a variation of the invention is not preferred since direct retrieval of Ms would not allow standardization and compensation of differences in Ad from printer to printer. The head gap setting process continues in FIG. 4D by setting the step count equal to zero (or Ms) and counting up (or down) to Ms (or zero) by execution of a loop including steps 495, 496 and 497. This completes the setting of the head gap in an automatic fashion in accordance with the thickness of any sheet material loaded into the printer.

It should also be noted that the method in accordance with the invention provides standardization as well as accuracy by establishing the head gap on the basis of an absolute home position to platen distance when the platen is undeflected and avoids a premium being placed on uniformity or rigidity of the printer carriage or platen structure. Platen flexure thereafter depends on the printing impact forces and will have little or no discernable effect on print quality. Further, by measuring the same platen deflection both with and without sheet material in the printer, platen flexure is removed as a source of error in the measurement of thickness of sheet material. Therefore, the invention is capable of improved accuracy at improved speed while avoiding the need for a decoder which would otherwise increase the cost of the printer. The system in accordance with the invention is also made readily applicable to many different printer geometries requiring no more modification than establishing default initial step counts in accordance with such geometries. By the same token, a wider degree of manufacturing tolerances of the printer and printer transport mechanisms can be accommodated to achieve uniformly high quality print results through the practice of the invention as described above.

While the invention has been described in terms of a single preferred embodiment, those skilled in the art will recognize that the invention can be practiced with modification within the spirit and scope of the appended claims.

Having thus described my invention, what we claim as new and desire to secure by Letters Patent is as follows:

1. A method of automatically setting a gap between a print head and a platen of an impact printer, including the steps of establishing a distance between a home position of said print head and said platen, moving said print head against said platen, moving said print head from said platen to said home position while accumulating a first distance measurement, moving said print head against said platen in steps by a distance greater than said first distance measurement by a fixed number of steps, moving said print head to said home position while accumulating a second distance measurement, placing sheet material between said print head and said platen, moving said print head against said sheet material, moving said print head from said sheet material to said home position while accumulating a third distance measurement, subtracting said third distance measurement from said first distance measurement to obtain a thickness measurement, selecting one of a head gap dimension and a head motion distance which corresponds to said thickness measurement, and moving said print head toward said platen in accordance with said at least one of a head gap dimension and a head motion distance.

2. A method as recited in claim 1, wherein said step of moving said print head against said platen includes the further step of developing a first force between said print head against said platen.

3. A method as recited in claim 2, wherein said step of moving said print head against said sheet material includes the further step of developing a first force between said print head against said sheet material.

4. A method as recited in claim 1, wherein said step of moving said print head against said sheet material includes the further step of developing a first force between said print head against said sheet material.

5. A method as recited in claim 4, wherein said step of moving said print head against said sheet material includes the steps of moving said print head a further fixed distance toward said platen at a first, relatively high, speed, and moving said print head at a relatively low speed.

6. A method as recited in claim 5, wherein said step of moving said print head against said sheet material at a relatively low speed includes the further step of reducing current to a motor which is provided in said printer for moving said print head.

7. A method as recited in claim 1, wherein said step of moving said print head against said platen includes the steps of moving said print head a further fixed distance toward said platen at a first, relatively high, speed, and moving said print head at a relatively low speed.

8. A method as recited in claim 7, wherein said step of moving said print head against said platen at a relatively low speed includes the further step of reducing current to a motor which is provided in said printer for moving said print head.

9. A method as recited in claim 7, wherein said step of moving said print head against said sheet material includes the steps of moving said print head a further fixed distance toward said platen at a first, relatively high, speed and moving said print head at a relatively low speed.

10. A method as recited in claim 9, wherein said step of moving said print head against said sheet material at a relatively low speed includes the further step of reducing current to a motor which is provided in said printer for moving said print head.

11. A method as recited in claim 1, wherein said step of establishing a distance between the further steps of moving said print head a fixed distance toward said platen, measuring a gap remaining between said print head and said platen to obtain a remaining gap dimension after said step of moving said print head a fixed distance toward said platen, and adding a said remaining gap dimension to said fixed distance.

* * * * *